US009303491B2

(12) United States Patent
Kanstad et al.

(10) Patent No.: US 9,303,491 B2
(45) Date of Patent: Apr. 5, 2016

(54) SUBSEA COOLER AND METHOD FOR CLEANING THE SUBSEA COOLER

(75) Inventors: Stig Kare Kanstad, Fana (NO); Nils-Egil Kangas, Nesttun (NO); Asmund Valland, Agotnes (NO); Atle Berle, Ulset (NO)

(73) Assignee: Framo Engineering AS, Bergen (NO)

( * ) Notice: Subject to any disclaimer, the term of this patent is extended or adjusted under 35 U.S.C. 154(b) by 1032 days.

(21) Appl. No.: 13/259,789

(22) PCT Filed: Mar. 29, 2010

(86) PCT No.: PCT/NO2010/000121

§ 371 (c)(1),
(2), (4) Date: Dec. 6, 2011

(87) PCT Pub. No.: WO2010/110676

PCT Pub. Date: Sep. 30, 2010

(65) Prior Publication Data

US 2012/0097362 A1 Apr. 26, 2012

(30) Foreign Application Priority Data

Mar. 27, 2009 (GB) ..... 0905338.0

(51) Int. Cl.
*F28D 1/02* (2006.01)
*F28F 9/02* (2006.01)
(Continued)

(52) U.S. Cl.
CPC ..... *E21B 43/01* (2013.01); *E21B 36/001* (2013.01); *E21B 43/12* (2013.01); *F28D 1/022* (2013.01); *F28F 9/0275* (2013.01); *F28G 9/00* (2013.01)

(58) Field of Classification Search
CPC ..... E21B 36/001; E21B 43/01; E21B 43/12; F28D 3/04; F28D 1/022; F28F 9/0275; F28G 9/00
USPC ..... 165/101
See application file for complete search history.

(56) References Cited

U.S. PATENT DOCUMENTS 1,449,753 A 3/1923 Hulsmeyer
2,059,255 A 11/1936 Lassiat
(Continued)

FOREIGN PATENT DOCUMENTS

DE 885714 C 8/1953
FR 2 098 411 A1 3/1972
(Continued)

*Primary Examiner* — Tho V Duong
(74) *Attorney, Agent, or Firm* — Conley Rose, P.C.

(57) ABSTRACT

There is disclosed a subsea cooler for the cooling of a fluid flowing in a subsea flow line. The subsea cooler comprises an inlet and an outlet which are connectable to the subsea flow line and at least two cooling sections arranged in fluid communication with the inlet and the outlet of the subsea cooler. Each cooling section includes a plurality of cooling pipes which are configured such that they exchange heat energy with the surrounding sea water when the subsea cooler is in use. The subsea cooler is further provided with valve means such that the flow of fluid through the cooling sections may be regulated individually. There is also disclosed a method for removal of accumulated wax, hydrates and sand and debris which has accumulated in the subsea cooler wherein separate cooling section are shut off whereby the temperature of the fluid flowing through the subsea cooler is increased thereby melting the wax and hydrates, and whereby the speed of the fluid flow through the subsea cooler is increased thereby jetting out sand and debris.

34 Claims, 14 Drawing Sheets

(51) Int. Cl.

| | |
|---|---|
| ***F28G 9/00*** | (2006.01) |
| ***E21B 43/01*** | (2006.01) |
| ***E21B 36/00*** | (2006.01) |
| ***E21B 43/12*** | (2006.01) |
| *F28D 3/04* | (2006.01) |

(56) References Cited

U.S. PATENT DOCUMENTS 2,670,933 A 3/1954 Bay
3,205,939 A 9/1965 Huet
3,850,741 A * 11/1974 Callahan ..... C10G 75/00 134/20
3,877,520 A * 4/1975 Putnam ..... E21B 23/002 166/366
3,942,589 A * 3/1976 Opitzer ..... F22G 1/005 122/32
4,163,473 A * 8/1979 Engelberts ..... B21C 37/22 165/157
5,065,815 A * 11/1991 David ..... C10J 3/56 165/145
5,533,355 A * 7/1996 Rawlings ..... 62/260
5,904,807 A * 5/1999 Ramm-Schmidt ..... B01D 3/008 159/15
2010/0252227 A1 * 10/2010 Sten-Halvorsen .... E21B 36/001 165/45

FOREIGN PATENT DOCUMENTS

WO 2005/001368 A2 1/2005
WO 2005/026497 A1 3/2005
WO 2006/010771 A1 2/2006
WO 2008/147219 A2 12/2008

* cited by examiner

SUBSEA COOLER AND METHOD FOR CLEANING THE SUBSEA COOLER

The present application relates to a subsea cooler for hydrocarbons flowing in a subsea flow line and particularly in connection with a subsea compressor/pump station, and also to a method for the removal of sand and/or debris which has accumulated in the subsea cooler.

Controlling the fluid temperature is important for the operation of a pump/compressor station. A too high or too low process temperature may, depending on the actual fluid properties, possibly result in various problems.

Low temperature on the process side may cause hydrate formation and lead to waxing, scaling or to excessively high viscosities, hence reducing the pumpability/compressability of the fluid.

Normally, the solubility increases with increasing temperature (normal soluble), but a few salts, i.e. the inverse soluble salts, behave differently. These are typically salts having increasing solubility with increasing temperatures when the temperature is above a certain temperature (typically about 35° C. for $CaCO_3$). Below this temperature the solubility increases with increasing temperature until a certain temperature, above which the solubility again decreases with increasing temperature. The solubility also depends on for example the pressure and changes in pressure.

A low process temperature will be further lowered as the fluid flows through the subsea cooler. On the process side, normal soluble salts may therefore be deposited. On the seaside the water will be heated. Salts may therefore be formed on the seaside if the process temperature is sufficient to bring the surface above the inversion point for inverse soluble salts.

High temperatures on the process side can limit the use of a compressor/pump, or can lead to scaling (normal soluble salts) or cause scaling on ambient side.

Rapid temperature changes may potentially cause temperature differences between internal pump/compressor parts and housing which may affect the lifetime of the pump/compressor.

The issues above may be detrimental to the pump/compressor stations potential to enhance or maintain production.

In WO 2008/147219 A2 there is disclosed a subsea cooler comprising an inlet manifold, an outlet manifold and a plurality of coils which are exposed to seawater such that the fluid flowing through the coils is cooled by the sea water. The cooler comprises a single section, and, therefore, as with other known subsea coolers, capacity regulation, sand removal, wax removal and hydrate control from the subsea cooler will be a problem. No attempt to solve these problems has been disclosed in this publication.

Furthermore, it is preferable that an even fluid distribution between individual cooler pipes is obtained for several reasons. One reason is that an uneven flow rates between individual pipes give rise to temperature differences between the pipes which may lead to deviation between actual and estimated cooler performance, unexpected fouling and damaging thermal stresses.

The effects from an uneven fluid distribution, which also applies to single phase coolers, is further enhanced in multiphase flow due to the density and specific heat variation between gas and liquid which magnifies the temperature difference between individual cooler pipes due to an uneven distribution of mixture flow rates.

An uneven distribution of gas and liquid flow rates can, for multiphase flow, also cause additional problems like hydrate blockage due to low temperature, due to uneven inhibitor distribution or a combination of the two. Wax deposits and scale are other problems that may arise due to the same challenges. Furthermore, an additional challenge which may occur in multiphase flow is slug-flow which may have detrimental effects on the construction due to amongst other water hammering. It is therefore advantageous to ensure sufficiently even fluid distribution for a subsea cooler which is intended for the cooling of hydro carbons.

It is an objective of the present invention to provide a subsea cooler which is not encumbered with the problems outlined above.

It is an object of the present invention to provide a subsea cooler in which the accumulation of sand and debris is eliminated or at least reduced.

It is also an objective of the present invention to provide a subsea cooler which can be efficiently cleaned for wax and/or hydrate and/or sand and debris which has accumulated in the subsea cooler.

It is also an objective of the invention to provide a subsea cooler in which there is an even distribution of fluid between different cooling sections.

It is also an objective of the present invention to provide a subsea cooler including the possibility for capacity regulation.

It is also an objective of the present invention to provide a subsea cooler which can provide some early warning signs of accumulation of fouling in the subsea cooler.

These objectives are achieved with a subsea cooler as defined in claim 1 and a method for the removal of sand and debris which has accumulated in the subsea cooler as defined in claim 35. Further embodiments of the present invention are defined in the dependent claims.

The subsea cooler disclosed herein provides a solution to the challenges outlined above. Particularly capacity regulation and removal of wax, hydrate and sand and/or debris from the subsea cooler will be described in more detail below. The internal distribution of fluid in the subsea cooler is also important and how to obtain an even fluid distribution between the individual cooler pipes will also be disclosed below. The subsea cooler may be used as a part of different subsea systems wherein a subsea cooler is needed, but the disclosed subsea cooler is particularly suitable as an inline subsea cooler for wet gas applications, i.e. where the fluid flowing through the subsea cooler comprises water and hydrocarbons in gaseous form. Normally there is also some condensate present, i.e. hydrocarbons in liquid form.

There are two alternative subsea cooler locations, which are principally different. The subsea cooler may be located in the main flow line, i.e. the pumped or compressed flow is always cooled, or the subsea cooler may be installed in a recirculation line, i.e. only cooling fluid flowing through the recirculation line.

Installing the subsea cooler in a recirculation line may be used for multiphase pumps while the inline subsea cooler, i.e. installed in the main flow line, can be used for wet gas applications where the temperature rise across the compressor is larger and the benefits from reducing the suction temperature are more important.

There is provided a subsea cooler for the cooling of a fluid flowing in a subsea flow line which comprises an inlet and an outlet which are connectable to the flow line. The subsea cooler comprises at least two cooling sections arranged in fluid communication with the inlet and the outlet of the subsea cooler. The cooling pipes are exposed to the seawater when the subsea cooler is installed, and therefore configured such that the fluid flowing through the subsea cooler exchanges heat with the surrounding sea water when the subsea cooler is in use. The subsea cooler further comprises at least one distributing pipe for each cooling section extending between a primary distribution point and respective cooling sections, where the distributing pipes are inclined relative to a horizontal plane when the subsea cooler is installed on the seabed such that the fluid flows downwards from the primary distribution point toward the cooling sections. Each cooling section preferably comprises at least one inlet manifold and at least one outlet manifold and a plurality of cooling pipes which extend between the inlet manifolds and the corresponding outlet manifolds.

In an embodiment of the subsea cooler, the cooling sections are symmetrically arranged around a longitudinal centre axis of the subsea cooler. The subsea cooler further comprises valve means such that the flow of fluid through the cooling sections may be individually regulated.

In an embodiment of the subsea cooler, each cooling section comprises two or more cooling towers, where each cooling tower comprises an inlet manifold, an outlet manifold and a plurality of cooling pipes extending between the inlet manifold and the outlet manifold. The cooling pipes are symmetrically arranged around a longitudinal centre axis of the respective cooling towers. Furthermore, the subsea cooler is preferably configured such that the cooling pipes extend in a substantially vertical direction between the inlet manifolds and the corresponding outlet manifolds when the subsea cooler is installed.

In an embodiment of the subsea cooler, the cooling towers are provided with a diffuser which diffuses the fluid flow before entering the cooler pipes. The diffuser may be provided with a flow blocking means which partially covers the diffuser's cross sectional area of fluid flow. The flow blocking means may comprise a plate which preferably is provided centrally in the diffuser's cross sectional area of fluid flow.

In an embodiment of the subsea cooler, the subsea cooler is provided with a mixer on the upstream side of the subsea cooler and/or each cooling section such that liquid droplets are broken down into smaller droplets and a homogeneous multiphase flow is obtained. If the mixer is arranged upstream the subsea cooler, the mixer may also work as damper of slug-flow.

In an embodiment of the subsea cooler, the distributing piping of the subsea cooler is provided with one or more flow restrictions such that liquid droplets are broken down into smaller droplets and a homogeneous multiphase flow is obtained.

In an embodiment of the subsea cooler, the subsea cooler comprises a bypass line across the subsea cooler such that at least a portion of the fluid flowing through the subsea cooler may bypass the at least two cooling sections. The subsea cooler bypass line preferably comprises a valve device for regulation of fluid flow through the subsea cooler bypass line.

A cooling section, or a part of a cooling section, may be designed as a cold zone and/or a warm zone such that the fluid flowing through the cooling section or the part of the cooling section, has a lower or a higher temperature respectively than the fluid flowing through the rest of the subsea cooler. This may be achieved by using cooler pipes with a smaller diameter (for higher temperature) or a larger diameter (for lower temperature) than the remaining cooler pipes. This may also be achieved in other ways, for example by using an insulating material for some of the pipes, using cooler pipes of different materials having different thermal conductive properties, mounting cooling fins and so on. Furthermore, the warm and/or cold zones are preferably provided with a temperature sensor and/or a pressure sensor which communicates with the control unit of a control system which controls the flow of fluid through the subsea cooler.

Therefore, in an embodiment of the subsea cooler, at least one cooling pipe of at least one cooling section is provided with a temperature lowering means such that fluid flowing through said at least one cooling pipe has a lower temperature than the fluid flowing through the other cooling pipes of the at least one cooling section.

Likewise, in an embodiment of the subsea cooler, at least one cooling pipe of at least one cooling section is provided with a temperature raising means such that fluid flowing through said at least one cooling pipe has a higher temperature than the fluid flowing through the other cooling pipes of the at least one cooling section.

The temperature measurements obtained in the cold and/or warm zones of the subsea cooler created by the temperature lowering means and temperature raising means respectively, may be used to detect when the conditions in the subsea cooler involves danger for formation of hydrates and/or wax.

There is also provided a method for removing wax and/or hydrate and/or sand and debris which has accumulated in the subsea cooler which comprises at least two cooling sections and valve means such that the flow of fluid through the cooler sections can be individually regulated, wherein the fluid flow through at least one of the cooling sections is shut off. Thereby the cooling of the fluid is reduced and accumulated wax and/or hydrate is melted. Furthermore, the speed of the fluid flow will increase and sand and debris, which has accumulated in the cooling section or sections of the subsea cooler through which the fluid is flowing, is jetted out. These steps may be repeated until all the cooling sections of the subsea cooler which need cleaning, have been cleaned.

Instead of completely shutting of the fluid flow through one or more cooling section, it would also be possible to reduce the flow rate through one or more cooling sections such that the temperature of the fluid is increased and wax and/or hydrate is melted, and the speed of the flow is increased and accumulated sand/debris is jetted out.

The subsea cooler may also comprise an insulated container arranged in fluid communication with the cooling sections. The insulated container should have a volume which is large enough to accommodate the liquid fraction of the fluid contained in the cooling sections of the subsea cooler such that the subsea cooler can be quickly drained if the need arises. The insulated container may be an insulated container of some sort that has the required size, an insulated pipe, tube or similar of the required size or another device that can store the fluid when the subsea cooler is drained. The subsea cooler may also be provided with means to remove the fluid from the insulated container, such as a pump.

Furthermore, at least one of the cooling sections may be provided with one or more temperature measuring devices and/or one or more pressure measuring devices. The temperature sensor(s) and/or the pressure sensor(s) preferably communicate with the control system through signal cables or through wireless communication means. As mentioned, the control system controls the valve device or valve devices, and may thereby regulate the flow of fluid through the individual cooling sections, based on the values measured by the temperature sensor(s) and/or the pressure sensor(s). Alternatively, some or all of the valve devices may be regulated manually, for example by using a ROV, based on readings of temperature and/or pressure and/or using predetermined procedures.

The subsea cooler may advantageously be employed in a subsea compressor system which is arranged in fluid communication with at least one flow line receiving fluid from at least one fluid source, for example a hydrocarbon well. In addition to the subsea cooler, the subsea compressor system preferably comprises a compressor or a compressor station which is provided with at least one compressor or pump. The subsea cooler is preferably arranged in the flow line upstream the compressor station such that the temperature of the fluid flowing in the flow line may be regulated before flowing through the compressor station. The fluid source may be one or more hydrocarbon wells producing well streams of hydrocarbons, which normally includes water and/or solid particles, flowing in flow lines. Two or more flow lines from different wells may be combined into a single flow line.

The required cooling capacity of the subsea cooler will depend on flow rates, arrival temperature at the compressor station, required pressure increase, etc. Cooling to much can cause hydrate and wax deposits while cooling to little may reduce the feasibility of the system. The actual cooling capacity will furthermore depend on seasonal variations in the ambient temperature and draught of the sea.

One way to change the subsea cooler's capacity is to regulate the cooler capacity/performance through adjusting the heat transferring area. That is, the subsea cooler discharge pressure and temperature is measured and when deviating from a set operating range, the cooler capacity is changed through changing the heat transferring area by shutting off or opening up one or more sections of the cooler.

This functionality is obtained by providing the subsea cooler with one or more valve devices in order to adjust the active cooler area versus desired cooler area. One design of the subsea cooler may be provided with two 50% cooling sections (i.e. two separate cooling sections, each with 50% of the required cooling capacity) installed in parallel inside the same lifting frame. Obviously, other designs are possible. The subsea cooler may for instance be split in four 25% cooling sections, or in one 50% cooling section and two 25% cooling sections and so on.

It is preferable, at intervals, to change between which sections that are isolated in order to prevent sufficient amount of hydrates to form blocking the cooling sections of the subsea cooler which are not in use. Alternatively, the unused cooling sections on both inlet and outlet of the subsea cooler may be isolated in order to prevent fluid from entering the cooling section or cooling sections which are not in use at a particular time. Allowing the fluid to slosh in and out of the section or sections of the subsea cooler which are not in use, may over time cause the pipe to be choked with overgrowth.

It would also be possible to regulate the capacity of the subsea cooler by letting a fraction of the fluid flow through a bypass line across the subsea cooler, using for instance a bypass choke. This method will further reduce the temperature of the fraction of the fluid flowing through the subsea cooler, although, in total, less energy will be removed by cooling, i.e. the temperature of the fluid downstream the subsea cooler, after the two fluid fractions (the fraction flowing through the subsea cooler and the fraction flowing through the subsea cooler's bypass line) have been mixed again, is higher than the case when all the fluid flows through the subsea cooler.

Sand or debris may, if not properly taken care of, accumulate in the cooler resulting over time in blockage of the cooler pipes.

Therefore, a pressure transmitter preferably is installed upstream the subsea cooler. The pressure drop across the subsea cooler can be used as a guide to when the subsea cooler needs cleaning on the process side.

Sand may be prevented from accumulating in the cooler through making the subsea cooler self drained by inclining the distributing and/or collecting manifolds. The potential for accumulation of sand and debris may be further reduced by, in addition to making the subsea cooler self drained, moving the outlet to the same side of the cooler as the inlet in such a way that the sand falls straight down the cooler pipes and is removed by the discharge flow.

Alternatively, the sand accumulated in the unit may be jetted out of the cooler through reducing the cooler area hence increasing the flow rate through the cooling sections in use. This can be done by using one or more valve devises to shut off cooling sections of the subsea cooler when jetting. Preferably, the compressor speed of the compressor station is increased at the same time if the subsea cooler is part of a subsea system including a recirculation line which recirculates at least a part of the fluid from downstream the compressor station to upstream the cooler and the compressor station. In that case, sand and debris which has accumulated in the unit, is jetted out of the subsea cooler by the increased flow rate through the subsea cooler.

Wax may over time deposit on the walls in the cooler reducing heat transfer performance. Preferably, the wax is removed by melting. This can be obtained by increasing the subsea cooler's discharge temperature.

As already mentioned, a pressure transmitter is preferably installed upstream the subsea cooler since the pressure drop across the subsea cooler combined with pump/compressor suction temperature may be used as a guide to when the subsea cooler needs cleaning. When it is required, the subsea cooler's discharge temperature may be increased for a period of time by reducing the cooling capacity. This can be obtained by shutting off one or more cooling sections of the subsea cooler, thereby reducing the cooling area. The at least one valve device arranged in the subsea cooler, can be used to adjusts the active cooling area versus desired cooling area.

A hydrate is a term used in organic and inorganic chemistry to indicate that a substance contains water. Hydrates in the oil industry refer to gas hydrates, i.e. hydrocarbon gas and liquid water forming solids resembling wet snow or ice at temperatures and pressures above the normal freezing point of water. Hydrates frequently causes blocked flow lines with loss of production as a consequence.

Hydrate prevention is usually done by ensuring that the flow lines are operated outside the hydrate region, i.e. insulation to keep the temperature sufficiently high or through inhibitors lowering the hydrate formation temperature.

Referring to FIG. 19, typical hydrate curves are shown for uninhibited brine and for the same brine with various amounts of hydrate inhibitor. The content of methanol increases from the left to the right, i.e. the leftmost curve is the 0 wt % curve and the rightmost curve is the 30 wt % curve. The flow lines are operated on the right hand side of the curves, since hydrates cannot form on this side.

Hydrates, if formed, are usually removed through melting. The flow line is depressurised to bring the operating conditions outside the hydrate region (the hydrate region is on the left hand side of the curve) or the hydrate curve is depressed through using inhibitors. A frequent method for hydrate removal is hence to stop production and bleed down the flow lines in order to melt the hydrates through depressurizing. It is often in these cases deemed important to depressurize equally the hydrate plug, i.e. on both sides, to reduce some of the dangers connected with this process (trapped pressurised gas which may cause the ice plug to shoot out when the ice plug loosens).

Hydrates will, during operation, start to form if the process temperature falls below the hydrate formation temperature at the operating pressure. The temperature reduction across the subsea cooler can hence cause hydrates to form which, given time, may partly or completely block the cooling pipes.

It is usually required that the flow line is kept above the hydrate formation temperature for a prolonged time in case of a shut down in order to gain time to intervene to prevent hydrates to form. The subsea cooler being non-insulated will be a major cold spot in the system and is hence a potential problem area in a shut down scenario. Therefore, it would be advantageous to have methods to prevent hydrates from forming and to obtain the required hold time in a shut down scenario. Furthermore, it would be advantageous to obtain a method to dissolve hydrates if the subsea cooler is partly or completely blocked.

During normal operation of the subsea cooler, the subsea cooler's discharge pressure and temperature can be measured and, if the operating conditions start to close in on the hydrate region, the distance to said hydrate region is increased by increasing the temperature. This can be obtained by decreasing the subsea cooler capacity by reducing the used cooling area. The active cooling area versus desired cooling area may be adjusted by providing one or more valve devices in the subsea cooler as explained above.

As mentioned above, the subsea cooler is preferably designed such that it is self draining, i.e. the liquid in the subsea cooler can within seconds, during a shut down, flow into an insulated section of the flow line or an insulated container, hence maintaining the liquid above the hydrate formation temperature during the required hold time for the field. The insulated length of pipe must have a sufficient volume to store the liquid volume contained in the subsea cooler.

A method for early detection of fouling would also be beneficial. Fouling is a term used for any deposits, i.e. wax, scale, hydrates etc. on the process side and scale and marine growth on the ambient side reducing the heat transfer between the subsea cooler and the sea water. An early indication of fouling may allow preventive measures to be taken to improve the situation.

As mentioned, this may be done by designing a cooling section of the subsea cooler such that the actual cooling section will have a lower temperature than the rest of the subsea cooler. Furthermore, to measure the temperature in the dedicated cooling section and use this measurement to detect if the temperature in the subsea cooler is dropping towards a critical temperature for waxing, hydrates, or inversely soluble salts (i.e. internal fouling).

The bulk fluid temperature entering or leaving the subsea cooler can be measured and compared to the critical temperatures for hydrates, wax and scale. There may however be colder spots in the equipment causing the fluid to drop below the critical temperatures without it being detected by the bulk temperature measurement. This can, for the subsea cooler, be due to for instance small variations in fluid distribution across the unit.

A section of the subsea cooler may therefore be designed in such a way as to ensure that the temperature is measured in a section of the equipment that is colder than the rest of the equipment. This may be obtained by providing one of the cooling pipes with a constriction which reduces the mass flow through the pipe, hence lowering the temperature further compared to the other cooling pipes. Other alternatives to ensure a lower temperature in a dedicated cooling section could be to increase the heat transfer by applying cooling fins etc. The "cold spot" temperature may then be used in combination with a pressure measurement and the hydrate curve for the actual fluids to detect when the unit tends to operate too close to the hydrate region.

The method described above can be further refined by dedicating another cooling section of the equipment to measure a high temperature. This may be obtained, through design, by increasing the flow rate through the pipe, for instance by using a larger diameter pipe, or by partly insulating the cooling pipe or pipes, or by other means. Changes in the deviation between the two temperature measurements can be compared and used to indicate a cold spot if the colder pipe tends to be clogged (wax, scale, hydrates) independently of changes in the ambient conditions (current, temperature).

Changes in the temperature deviation can furthermore also be used to detect external or internal fouling hence providing information regarding the need for cleaning.

The methods for early detection of fouling described above, by employing cold and warm zones and temperature measurements in the cold and warm zones, may in certain circumstances, for example when there are changes in sea currents and temperature of the sea water, provide inaccurate results.

An alternative method for obtaining early detection of fouling would be to utilize differential pressure measurements over a restriction in the cold and the warm zone respectively where the restrictions are employed to ensure equal fluid distribution to the individual cooling pipe. The relative change in pressure between the restrictions may be used to indicate whether the relative fluid flow through the cooling pipes has changed independently of changes in process temperature, sea temperature or sea currents. The same effect could also be achieved by using ultrasonic speed sensor (or any signal which can be measured and which changes when the flow rate changes).

A further alternative to detect fouling would be to use a gamma densitometer to measure the density in a cross section of cooling pipes such that it would be possible to discover hydrates being deposited on the wall of the cooling pipes or lumps of hydrates in the fluid flow etc.

Furthermore, the cooling capacity of the subsea cooler can be increased by using forced convection instead of free convection as long as the design can benefit from a better usage of the cooling effect from sea current.

The Omni directional sea current which is nearly always present, will increase the overall heat transfer coefficient compared to only free convection. The effect of free convection is however unstable due to changes in flow direction and the stations steel structure acting as a "wind screen" slowing down the current velocity.

The subsea cooler may therefore be provided with a sea current driven impeller including a propeller pump with one or more propeller devices to increase the rising velocity of the thermal plume. The propeller pump may be rotatably arranged above the cooling section such that sea water is drawn up through the propeller pump when it is rotated by the sea current. This way the cooling capacity can be increased when sea current is present with only a limited increase in the system complexity.

The efficiency may be further increased by adding a skirt around the cooler to further emphasis the rising flow velocity of the sea water. Two conically shaped skirts may also be used to enhance the cooling capacity of the subsea cooler. The skirts may be arranged such that the sea current flows in between them and creates a sea current through the subsea cooler which enhances the capacity of the subsea cooler.

Below, non-limiting embodiments of the invention will be explained with reference to the figures, where FIG. 1 shows a perspective view of a cooling section of a first embodiment of the subsea cooler, FIG. 2 shows a side view of a cooling section of a first embodiment of the subsea cooler, FIG. 3 shows a side view of a cooling section of a first embodiment of the subsea cooler, FIG. 4 shows a top view of a cooling section of a first embodiment of the subsea cooler, FIG. 5 shows a side view of a first embodiment of the subsea cooler, FIG. 6 shows a side view of a first embodiment of the subsea cooler, FIG. 7 shows a top view of a first embodiment of the subsea cooler, FIG. 8 shows a perspective view of a second embodiment of the subsea cooler, FIG. 9 shows a side view of the second embodiment of the subsea cooler, FIG. 10 shows a top view of the second embodiment of the subsea cooler, FIG. 11 shows a perspective view of a cross section in the longitudinal direction of an inlet manifold of the second embodiment of the subsea cooler, FIG. 12 shows an embodiment of the inlet manifold of the second embodiment of the subsea cooler, including a blind-T.

FIG. 13 shows an alternative embodiment of the inlet manifold of the second embodiment of the subsea cooler, where the inlet manifold includes a nozzle.

FIGS. 14*a* and 14*b* shows two alternative configurations of the cooling sections where the cooling sections are symmetrically arranged around the riser pipe.

FIG. 15*a*-15*c* shows possible locations for arranging valve devices which are used to control and regulate the fluid flow through the different cooling sections of the subsea cooler.

FIG. 16 shows the subsea cooler with a bypass line which can be used for regulation of the flow fraction through the subsea cooler.

FIG. 17*a* shows a side view of an a sea current driven impeller including a propeller pump with one or more propeller devices.

FIG. 17*b* shows a top view of the sea current driven impeller shown in FIG. 17*a*.

Figure 1:
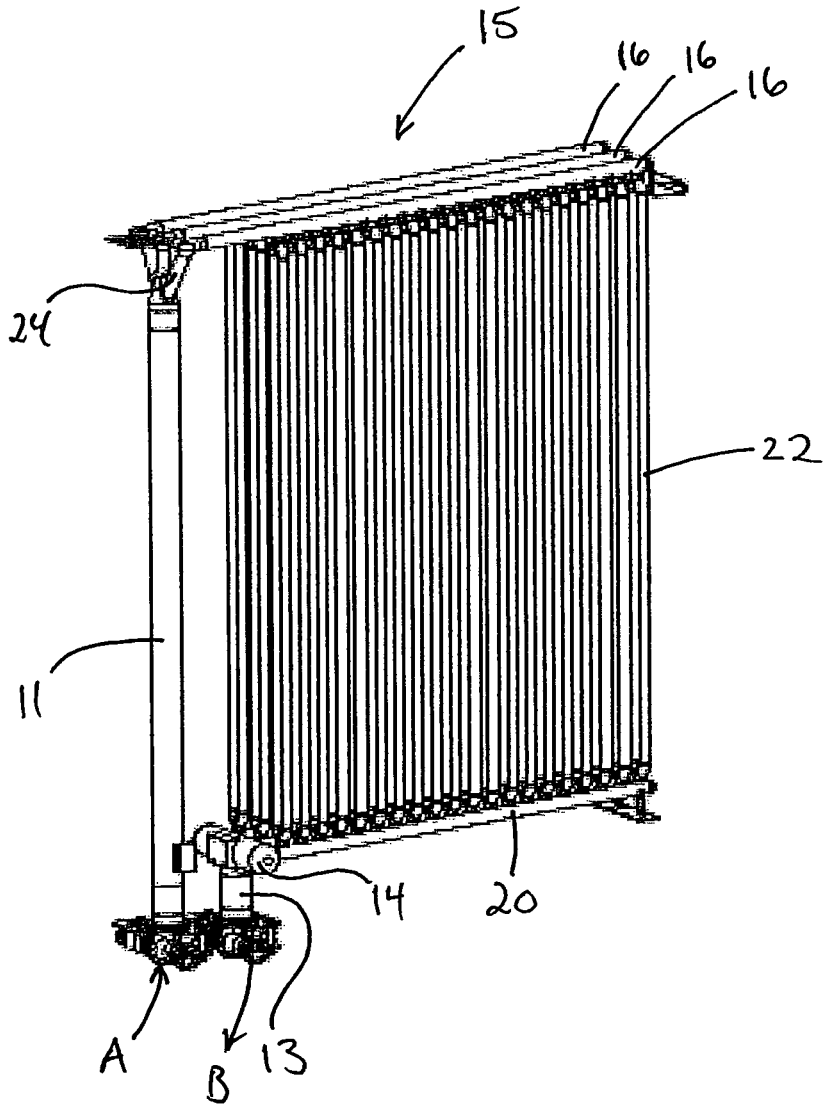
Figure 2:
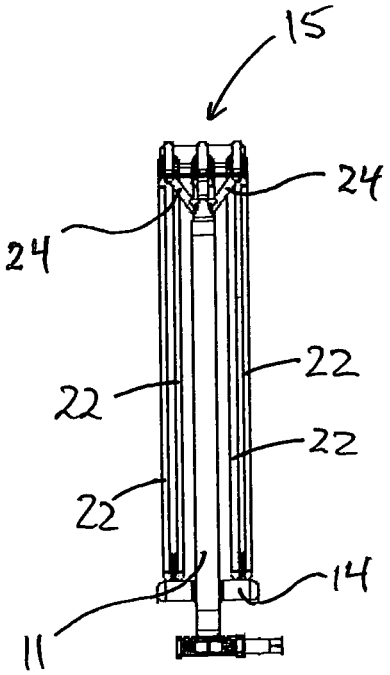
Figure 3:
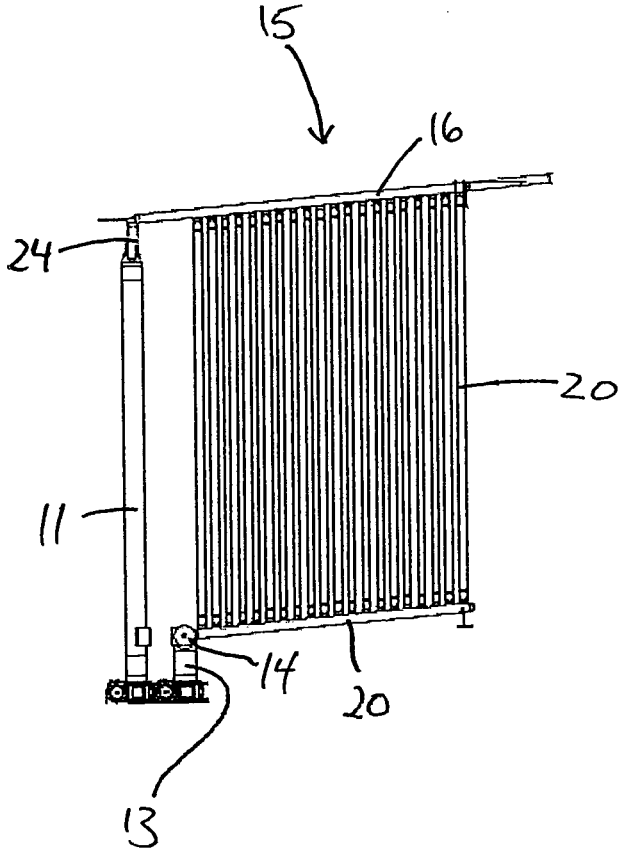
Figure 4:
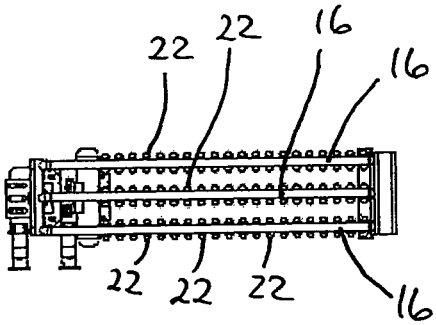

In FIGS. 1-4 there is shown a cooling section 15 of the subsea cooler. The cooling section 15 comprises a riser pipe 11 with an inlet, indicated with the letter A, which may be connected to a flow line (not shown). To the riser pipe 11 there is mounted a distributing pipe 24, which divides the fluid flow in the riser pipe 11 into three branches. To each branch of the distributing pipe 24 there is connected an inlet manifold 16.

Similarly, the subsea cooler 10 comprises an outlet pipe 13, which is connected to a collecting manifold 14. To the collecting manifold there are connected three outlet manifolds 20 which are preferably located at a lower position than the inlet manifolds 16 when the subsea cooler is installed. As shown in the figures, the number of distributing manifolds 16 is equal to the number of collecting manifolds 20. This is, however, not necessary and one may for example imagine a cooling section 15 being provided with fewer outlet manifolds 20 than inlet manifolds 16.

Between the inlet manifolds 16 and the outlet manifolds 20 at least one, but preferably a plurality of cooling pipes 22 extend. The subsea cooler 10 is configured such that the cooling pipes 22 are exposed to the surrounding sea water under operating conditions and therefore the fluid flowing through the subsea cooler exchanges heat energy with the surrounding sea water.

As seen on FIGS. 1-4, the cooling pipes 22 are preferably configured such that they are substantially vertical when the subsea cooler 10 is installed and operating. The outlet manifolds 20 and the inlet manifolds 16 are preferably configured such that they are sloping or slanting relative to a horizontal plane. This is clearly shown in FIG. 3. Fluid flowing into the cooler, as indicated by arrow A in FIG. 1, will flow up through the riser pipe 11 and through the distributing piping 24 and thereafter the inlet manifolds 16. Then the fluid flows downward through the cooling pipes 22 and further through the slanting outlet manifolds 20 and collecting manifold 14, and finally out through the outlet pipe 13, as indicated by arrow B. The substantially vertical configuration of the cooling pipes 22 and the slanting configuration of the outlet manifold 20 and the inlet manifold 16 makes it easier to remove sand and debris from the subsea cooler 10.

Figure 5:
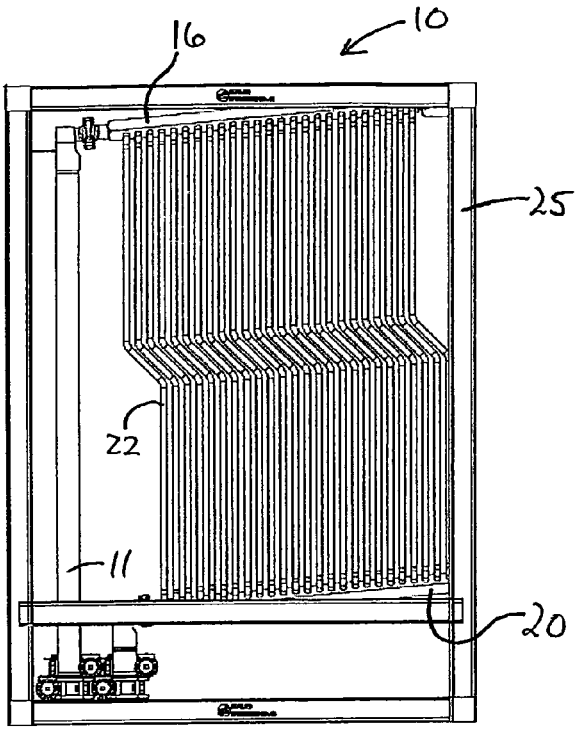
Figure 6:
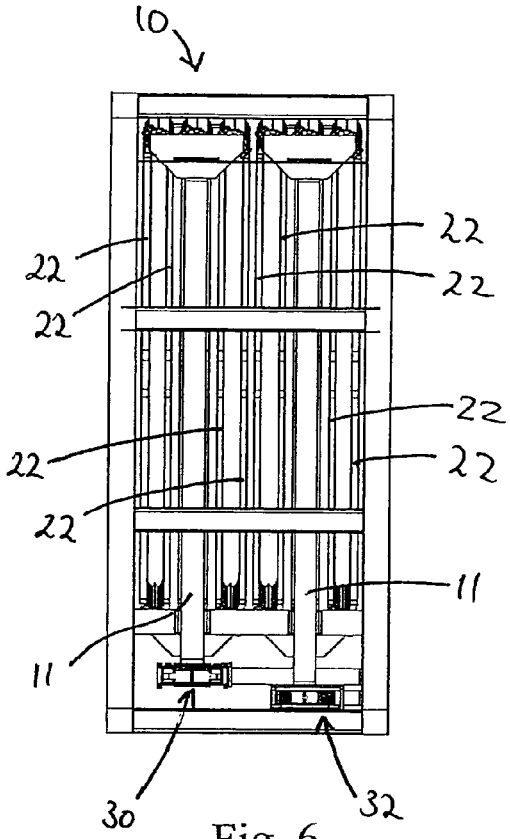
Figure 7:
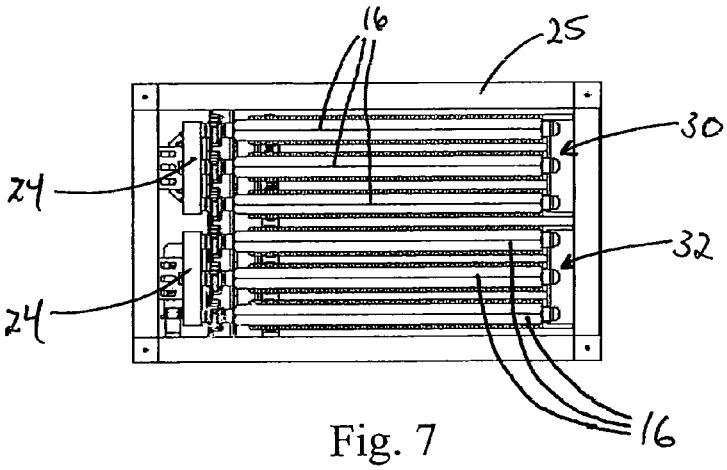

In FIGS. 5-7 a subsea cooler 10 with two cooling sections is shown arranged in a frame 25. The subsea cooler 10 is provided with a first cooling section 30 and a second cooling section 32. Each cooling section 30, 32 is designed in the same way as the cooling section 15 disclosed in FIGS. 1-4, and is provided with distributing pipes 24 connected to three inlet manifolds 16 and outlet manifolds 20 connected to outlet pipes (not seen in the figures). Between the inlet manifolds 16 and corresponding outlet manifolds 20 there are provided at least one, but a preferably a plurality of cooling pipes 22 which, as shown, are configured to exchange heat energy with the surrounding sea water when the subsea cooler 10 is installed and in use.

Furthermore, the subsea cooler 10 is provided with one or more valve devices (not shown in the figures) which communicate with a control system which is capable of controlling the valve devices such that the flow of fluid through the cooling sections 30, 32 of the subsea cooler 10 may be controlled and regulated. By remote control of the valve device or valve devices, the fluid may be arranged to flow through both cooling sections 30, 32 or only one of the cooling sections, and the rate of fluid flow through any given cooling section 30, 32 may be adjusted to a desired level.

The subsea cooler 10 shown in the FIGS. 1-7 is configured with one or two cooling sections. The subsea cooler may, however, be provided with more than two cooling sections if so desired. Each cooling section could also be provided with more than three or less than three inlet manifolds 16 and outlet manifolds 20 as shown on the figures.

Figure 8:
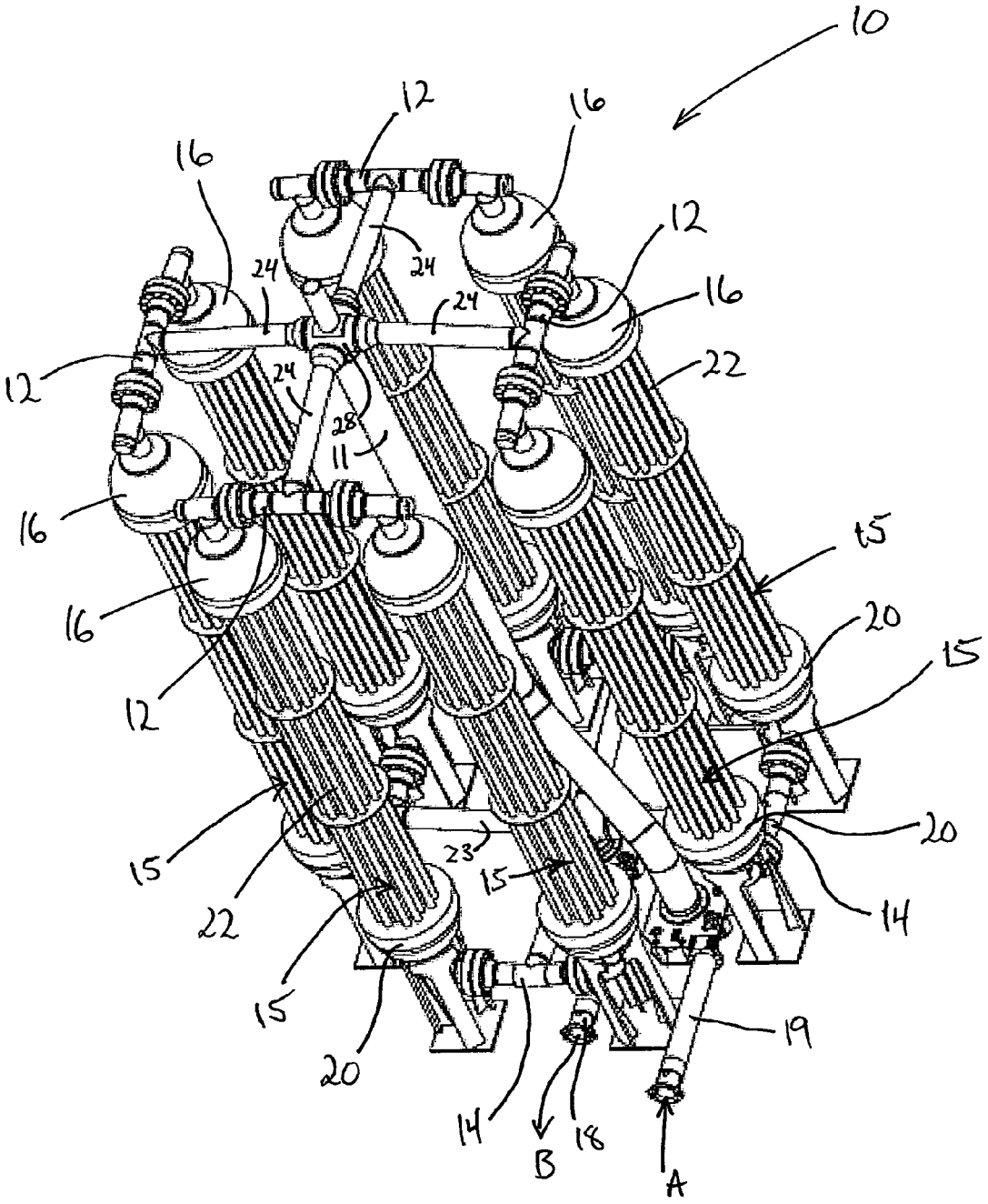
Figure 9:
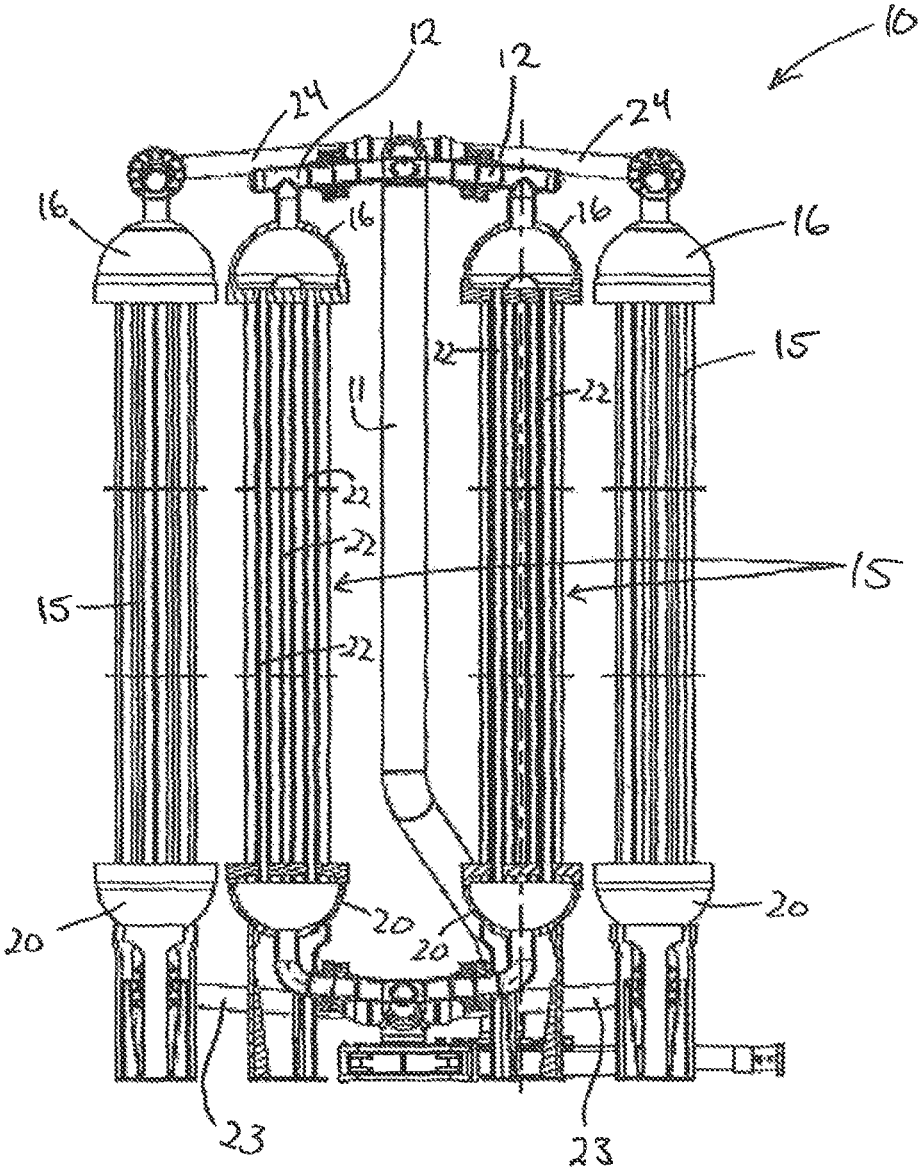
Figure 10:
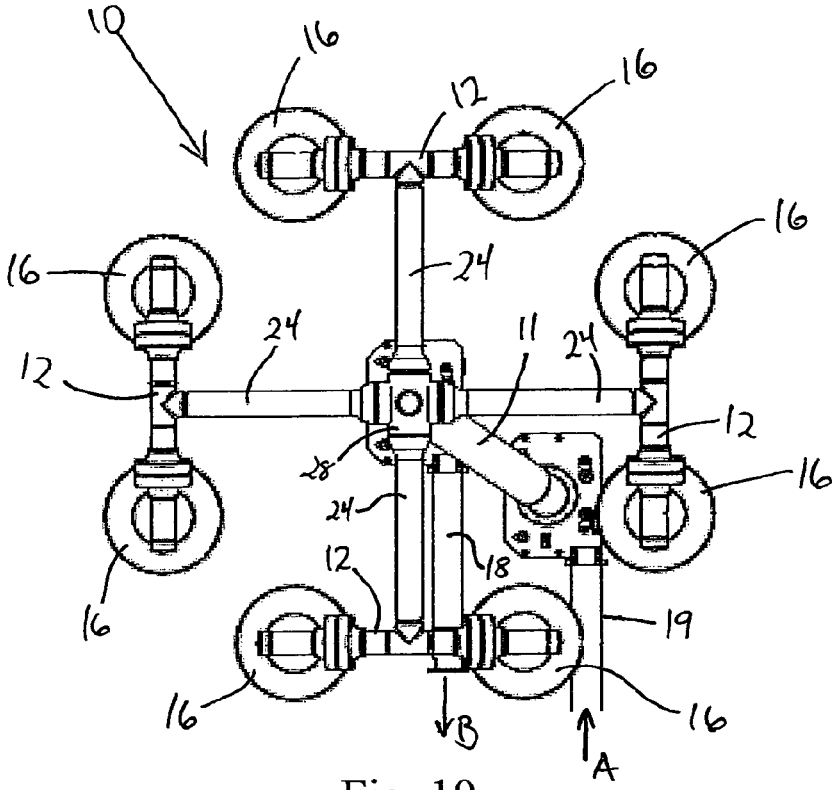

In FIGS. 8-10 there is disclosed a second embodiment of the subsea cooler 10. Although the design is different from the subsea cooler disclosed above, the subsea cooler 10 shown in FIGS. 8-10 comprises the same main components as the subsea cooler disclosed in connection with FIGS. 5-7. The subsea cooler 10 shown in FIGS. 8-10 comprises eight cooling sections 15, arranged in pairs of two cooling sections. The cooling sections 15 are all arranged symmetrically about a central axis of the subsea cooler 10 such that the fluid will follow the same fluid path from the flow line through the subsea cooler regardless which cooling section 15 the fluid flows through.

Each cooling section 15 comprises an inlet manifold 16 which is connected to a second distributing pipe 12 which distributes the fluid flow to two cooling sections 15.

At the upper end of the riser pipe 11 there is mounted a primary distributing point 28 which splits the fluid flow entering the subsea cooler 10 through the riser pipe 11. The primary distributing point 28 is connected to the second distributing pipes 12 through respective distributing pipes 24. Preferably, the primary distributing point 28 is positioned at a higher level than the cooling sections 15 such that the fluid flows downwards through the distributing pipes 24, the distributing pipes 12 and the cooling sections 15 when the subsea cooler 10 is operating.

Figure 14B:
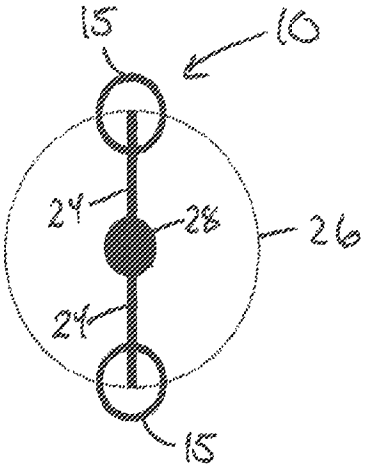
Figure 14A:
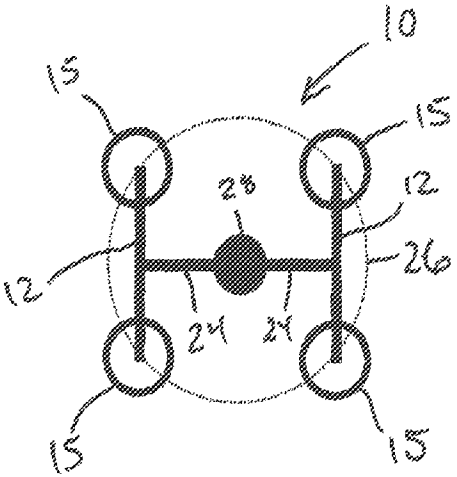

Other possibilities for such symmetric locations of the cooling sections 15 are shown schematically in FIGS. 14*a*-14*b*. In these two figures the primary distributing point 28 is shown. From the primary distributing point, the fluid is evenly distributed through distributing pipes 24 and possibly second distributing pipes 12 if necessary, to the cooling sections 15. The circle 26 is included to indicate that the cooling sections 15 are symmetrically arranged. It can also be seen that the fluid flows through the same fluid path from the primary distributing point 28 to the cooling sections 15 regardless of which cooling section 15 the fluid flows through.

The inlet manifolds 16 of the cooling sections 15 distributes the fluid flowing into the cooling sections 15 evenly into a plurality of cooling pipes 22 which are connected to the inlet manifolds 16. The subsea cooler 10 is configured such that the cooling pipes 22 are exposed to the surrounding sea water whereby the fluid flowing through the cooling pipes 22 is cooled.

The cooling pipes 22 of each cooling section 15 are, at their lower ends, connected to an outlet manifold 20 which collects the fluid flowing into the outlet manifold from the cooling pipes. The outlet manifolds 20 of a cooling section 15 are connected to collecting pipes 14. From the collecting pipes 14 the fluid flow through second collecting pipes 23 and finally exits the subsea cooler 10 through an outlet pipe 18 which connectable to the flow line. Likewise, a connecting pipe 19 is arranged in fluid communication with the riser pipe 11, and is connected to the flow line when the subsea cooler is installed. The preferred direction of flow of fluid into the subsea cooler 10 is indicated with an arrow A in FIGS. 8 and 10, and the flow of fluid out of the subsea cooler 10 is indicated with an arrow B in FIGS. 8 and 10.

The subsea cooler 10 is preferably provided with one or more valve devices (not shown in FIGS. 8-10) whereby the fluid flowing through the cooling sections 15 may be controlled and regulated independently of each other. Such valve devices may for example be arranged in the distributing pipes 24 and/or the first distributing pipes 12 and/or the primary distributing point.

Figure 15C:
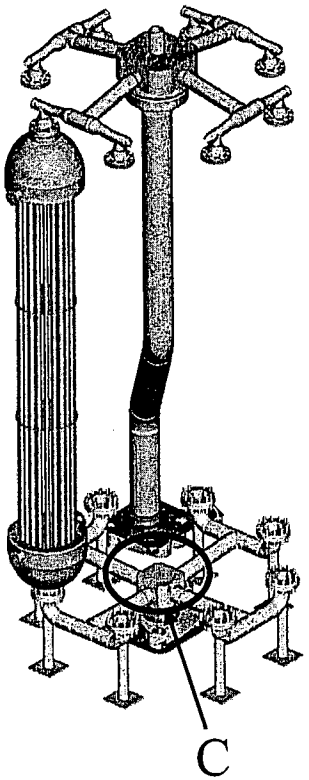
Figure 15B:
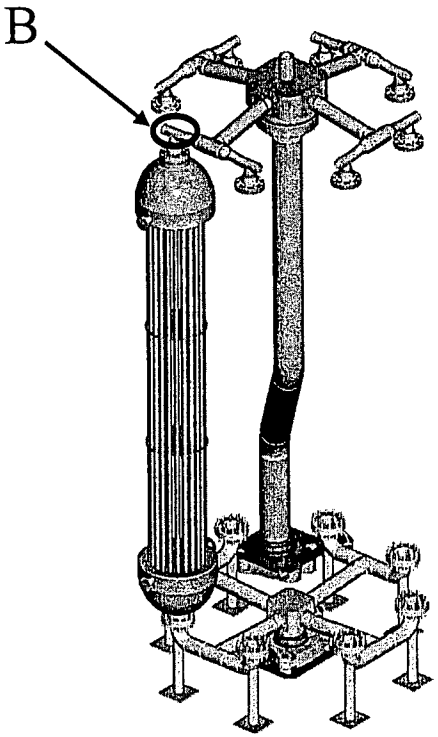
Figure 15A:
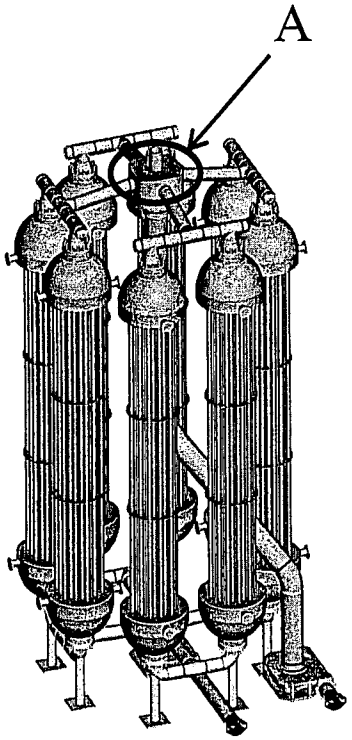

Some possible locations for the valve devices are indicated in FIGS. 15*a*-*c*. In FIG. 15*a* there is indicated that a valve device may be included in the primary distributing point as shown by arrow A, for example a three-way valve for capacity regulation and flushing of the subsea cooler 10. In FIG. 15*b* there is indicated that the same type of valve device may be provided in the second distributing pipes 12 as shown by arrow B, also for capacity regulation and flushing of the subsea cooler 10. In FIG. 15*c* there is indicated that a valve device may be provided at the inlet of the subsea cooler 10 as shown by arrow C, for example an on/off-valve or chokes for capacity regulation and flushing of the subsea cooler 10.

When the subsea cooler 10, as shown in FIG. 8-10, is installed and in use, the fluid flows through the riser pipe 11. At the primary distributing point 28, the fluid flow is split into a number of distributing pipes 24 which are connected to respective distributing pipes 12 at a second distributing point 29 in which the fluid flow is further split evenly into the two distributing pipes 12 which are connected to the inlet manifolds 16 of the cooling sections 15. Thereafter the fluid flows down through the cooling pipes 22 which are exposed to the surrounding sea water, into the outlet manifolds 20 of the cooling sections 15. Finally the fluid flows through second collecting pipes 23 and leaves the subsea cooler through the outlet pipe. As mentioned in connection with the description of FIGS. 14*a*-14*b* above, the second distributing pipes 12 may not be present, depending on the design of the subsea cooler 10.

The centre dome of the inlet manifold 16 is designed in order to create a chaotic flow pattern inside the inlet manifold 16 and provide an evenly distributed fluid flow in the "annular" cross section above the entrance for the individual cooling pipes 22. One of the effects will, amongst others, be a droplet break down resulting in smaller droplets which easier follows the gas flow, i.e. reduced gas liquid separation tendencies are obtained. The cooling pipes 22 are preferably distributed in an "annular" cross section of the cooling towers 17 not using the centre of the plate in order to prevent an uneven distribution of fluid between the cooling pipes 22 in the central area and the periphery. The height of the "annular section", from the manifold inlet to the exit into the cooler pipes, is to allow a redistribution of the process fluid prior to flowing into the individual cooling pipes 22, hence improving the liquid/gas distribution of the fluid.

In the design described above, the process fluid flows upwards in the centre of the cluster of cooling sections 15 through the riser pipe 11 and is divided out symmetrically. There are a number of arrangements where a 100% symmetrical inlet and outlet arrangement can be obtained where the flow path is identical for all flow paths though the whole subsea cooler 10 from the flow is split the first time in the primary branching point 28 and until the last remixing of the fluid. One example is shown in FIGS. 8-10 and two more examples are shown in FIGS. 14*a*-14*b* as described above.

As mentioned, the piping is, from the primary branching point 28 where the fluid flow is first split, preferably tilted downwards in order to ensure a symmetrical fluid split even if the subsea module is not completely horizontal. Gas and liquid will tend to separate out differently into the branches if one is slightly upwards and the other slightly downwards. This effect is strongly reduced if all branches have a defined inclination (i.e. an inclination of −47° and −44° (relative to a horizontal plane) will not create a large difference while +2° and −2° may). Although not a preferred option, the subsea cooler 10 may also be arranged such that the fluid flow is upwards through the cooling pipes 22.

Due to its modular construction, the module based subsea cooler 10 disclosed may be arranged in a multiple of arrangements in order to provide an even distribution between separate cooling sections in order to obtain the desired total cooling requirement.

An even distribution of the fluid can be further enhanced by using radial mixing, for example by employing the mixing part of the applicant's own mixer. That is, turbulent shear layers are utilized in order to tear the liquid into small droplets evenly distributed across the pipe cross section. Droplets, if small enough, will not have sufficient momentum to deviate from the gas flow. The flow direction and flow velocity of the droplets will hence be the same as for the gas flow.

A strong mixing process will in addition ensure an even distribution of inhibitors across the cross section of the inlet manifold 16, thereby ensuring that the proportion between process fluid and inhibitor is maintained in all cooling sections 15 of the subsea cooler 10.

Radial mixing can be used upstream the individual subsea coolers in order to provide a better fluid distribution into the subsea coolers or upstream any cooling section 15 where the fluid flow has been split.

It would be desirable to achieve a good fluid distribution in the inlet manifold 16 and thereby into the individual cooling pipes 22. In the discussion below it is assumed that the multiphase flow can be treated as a homogenous flow at the inlet of the distribution manifold.

A 100% symmetric flow pattern from the piping manifold 16 and into the individual pipes can be obtained by having a centric inlet and locate all cooling pipe exits on the same radius.

Furthermore, a diffuser, if properly designed, will provide a nearly flat velocity profile and full static pressure recovery in the inlet manifold 16. Droplet distribution will in addition tend to be improved through the droplet break down and fluid mixing caused by the high turbulence level caused by the diffusion process.

Distributing the cooling pipes 22 so that each cooling pipe 22 has the same drainage area will ensure the same flow rate (GVF and mass) into each individual cooling pipe 22.

The height of the diffuser increases the total height of the cooler which may become too high for some installation vessels. The height of the diffuser may in those cases be reduced by for example using guide vanes and/or vortex generators etc.

Figure 11:
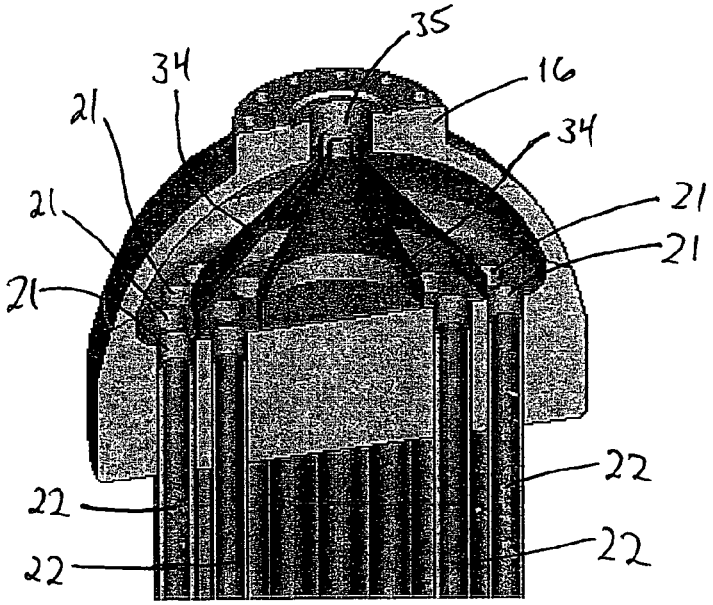

The use of guide vanes is shown in FIG. 11. The inlet manifold 16 shown in this figure is provided with two guide vanes 34 which extend from the inlet 35 of the inlet manifold 16 to the inlet of the cooling pipes 22. The guide vanes 34 are arranged such that the fluid flow is evenly distributed between the cooling pipes and guided from the inlet 35 of the inlet manifold 16 and towards the corresponding cooling tubes 22.

Complete diffusion may in some cases be difficult to obtain across the whole cross section of the distribution plate. The desired fluid distribution may in those cases be obtained for instance by blocking of the centre section of the distribution plate hence guiding the flow into an annulus which will then be the distribution manifold.

The height of the annulus is preferably high enough to allow for pressure recovery and hence a proper distribution into the individual cooling pipes 22. Furthermore, the annulus may be formed as a diffuser to further improve the distribution while at the same time allowing for a reduction in the height of the diffuser.

Figure 12:
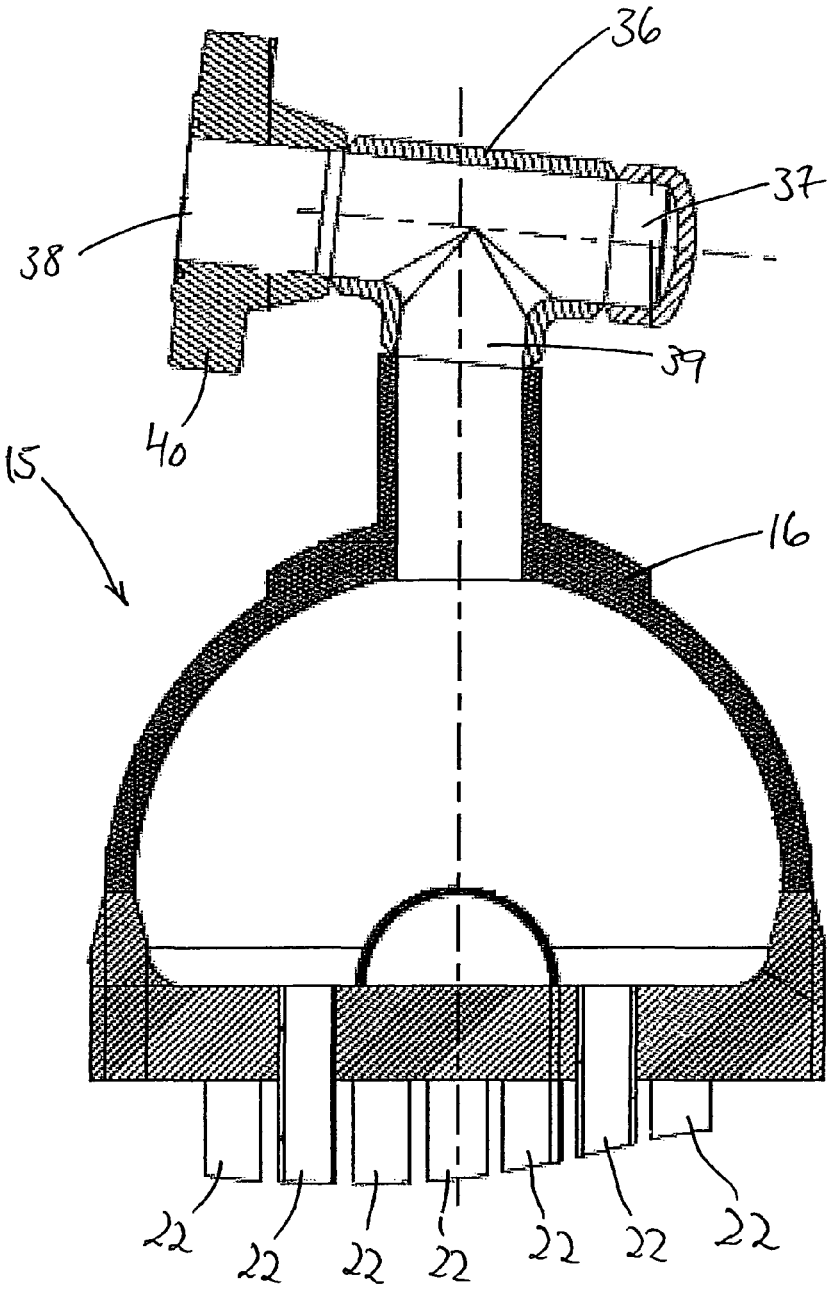

A homogenous mixture could be obtained by routing the flow into a blind-T just upstream the inlet of the manifold. The blind-T or similar piping arrangement, destroys fluid distribution patterns if the inlet piping is more horizontal. This is shown in FIG. 12 where a blind-T 36 is mounted on an inlet manifold 16 of a cooling tower 17. The inlet 38 of the blind-T is arranged with a flange 40 such that the blind-T can be mounted to a distributing pipe 12. Opposite the inlet 38 the blind-T is provided with a blind end such that when fluid enters the blind-T through the inlet 38 it will flow to the end of the blind-T where it is forced to return and thereafter exit through the outlet 39 of the blind-T. A small re-entrainment "vane" could also be used in combination with a blind T in order to prevent liquid from collecting on the wall.

Figure 13:
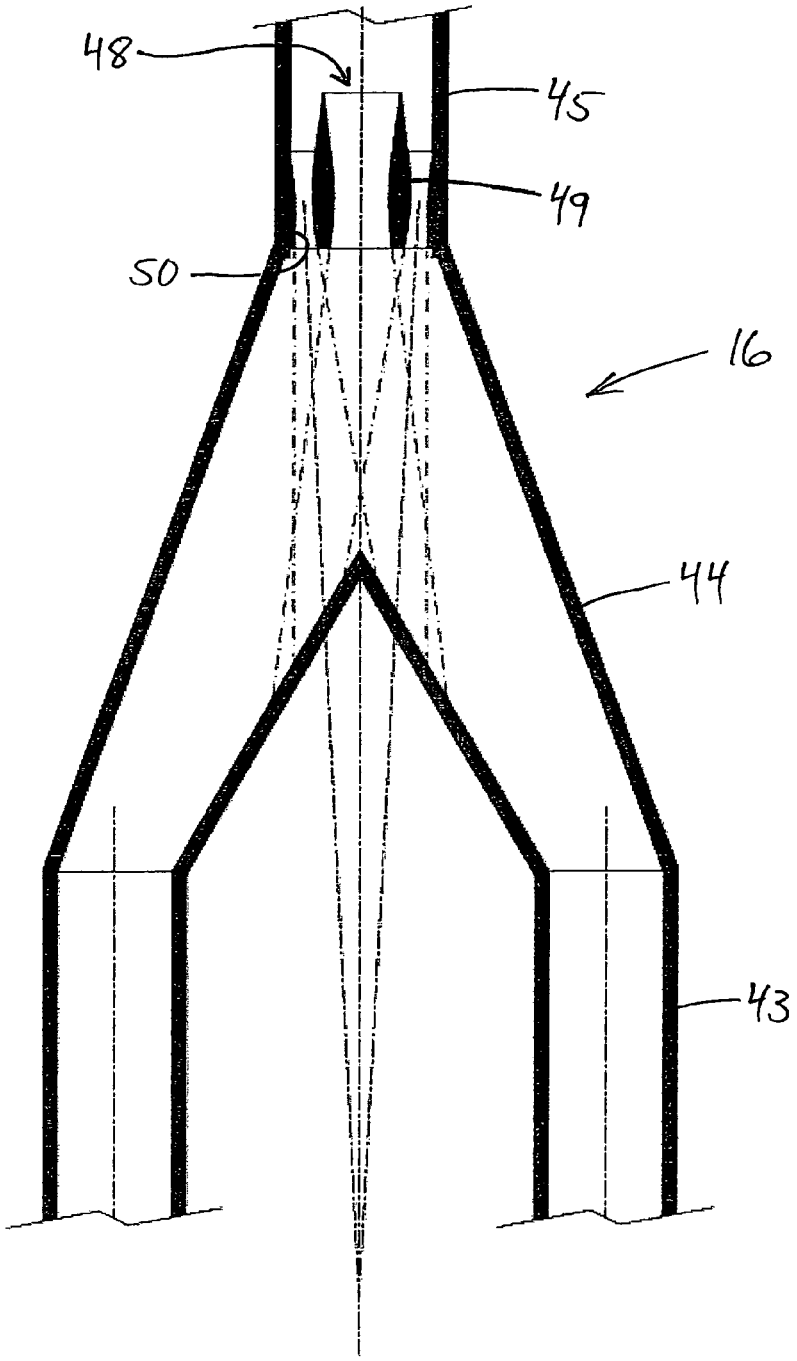

As mentioned above, a homogenous liquid/gas mixture may also be obtained by using turbulent shear layers generated by restrictions in the flow line. An example is shown in FIG. 13 where there is also disclosed a slightly differently shaped inlet manifold 16. The inlet manifold 16 shown in the figure is formed by a conical part 44 and an annular part 43. The annular part 43 is provided with an annular form and is connected to the conical part 44 at its upper end. The conical part 44 is connected to a manifold inlet 45 at its upper end, which may be part of the distributing piping 12, 24.

As shown in FIG. 13 there may be provided a restriction or nozzle 48 in the manifold inlet 45 which preferably is designed such that the jets from the nozzle or restriction atomizes the flow and creates turbulent shear layers, indicated by the dashed lines in the figure. Liquid which is stuck to the wall, is also re-entrained. The nozzle/ shown is formed with an inner ring 49 and an outer ring 50. The outer ring 50 is attached to the manifold inlet 45. The inner ring may be connected to the outer ring 50 by connecting means like for example three or more plate bodies (not shown in FIG. 13) distributed around and attached to the circumference of the inner ring 49 and the outer ring 50. The design of the nozzle 48 is preferably such that fluid flowing through the central, through going hole in the inner ring 49 and the annulus formed between the inner ring 49 and the outer ring 50 is prevented from sticking to the inner wall of the inlet manifold 16. The dashed lines shown in FIG. 13 indicates the turbulent shear layers created by the nozzle 48 which provides an improved distribution of the gas and the liquid in the fluid flow.

Figure 16:
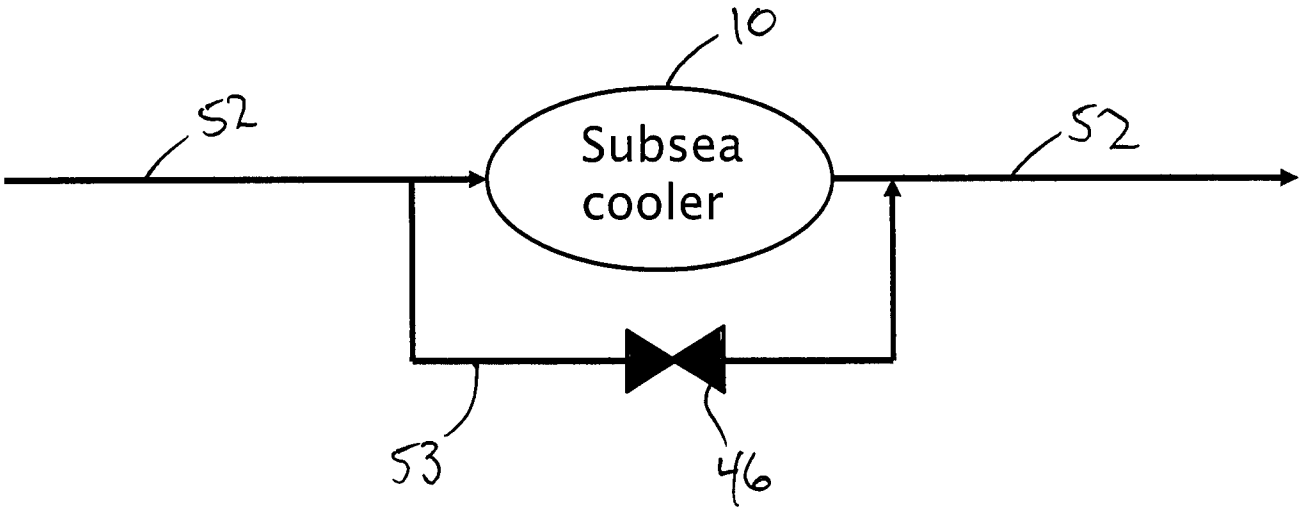

For regulation of the fraction of fluid flow which flows through the subsea cooler 10, the subsea cooler is preferably provided with a bypass line as schematically shown in FIG. 16. The subsea cooler 10 is shown connected to the flow line 52. The bypass line 53 is fluidly connected to the flow line 52 upstream and downstream the subsea cooler 10 and includes a valve device which is capable of regulating the fraction of the fluid flowing through the cooling sections 15 of the subsea cooler 10.

Figure 17B:
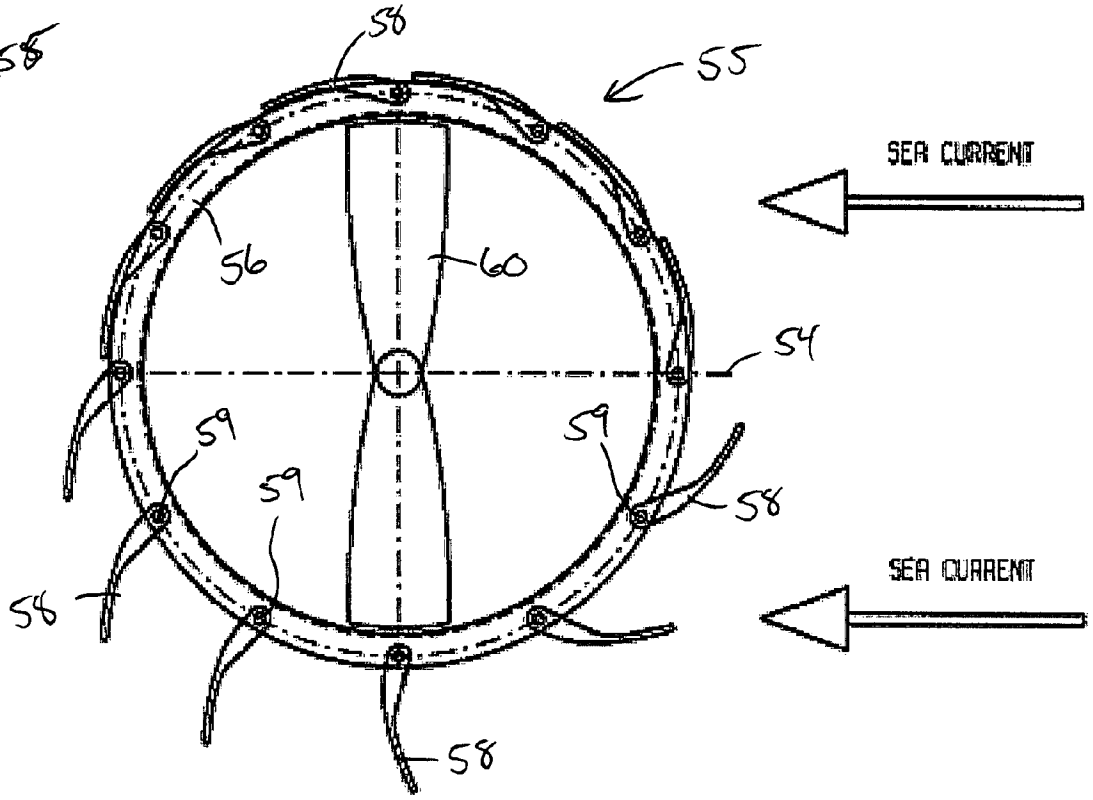
Figure 17A:
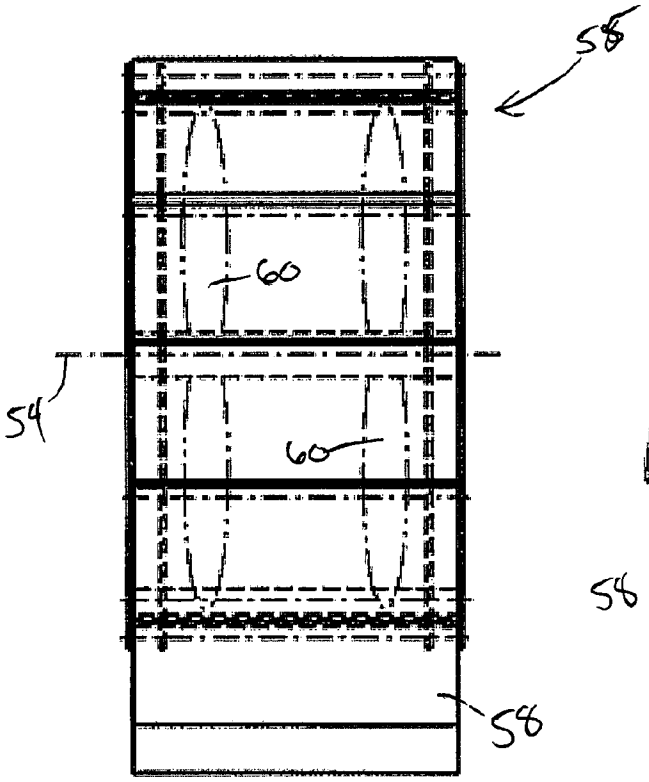

In FIGS. 17*a* and 17*b* there is shown a propeller pump 55 which the subsea cooler may be provided with in order to enhance the cooling capability of the subsea cooler 10. The propeller pump 55 comprises a cylindrical body 56 which is rotatably arranged above the subsea cooler 10. The cylindrical body 56 is provided with a plurality of vanes 58 which are pivotably connected to the cylindrical body 56 by a bolt 59, hinges or any other suitable means. As the propeller pump rotates, the vanes 58 will pivot out from the cylindrical body 56 when they are on the side of the cylindrical body which rotates in generally the same direction as the sea current. When the vanes are moving in a direction generally against the sea current, the vanes 58 will lie next to the cylindrical body 56 to provide as little flow resistance as possible. In this way the propeller pump 55 is driven by the sea current. The principle should be easily understood from FIG. 17*b*. Inside the cylindrical body 56 there is provided at least one propeller which preferably extends across a diameter of the cylindrical body 56 and is attached to the inner wall of the cylindrical body. When the propeller pump 55 is rotated by the sea current, the propeller is arranged such that sea water is drawn up through the cylindrical body 56, which in turn creates a stronger current of sea water through the subsea cooler 10 thereby increasing the cooling capacity of the subsea cooler.

Figure 18:
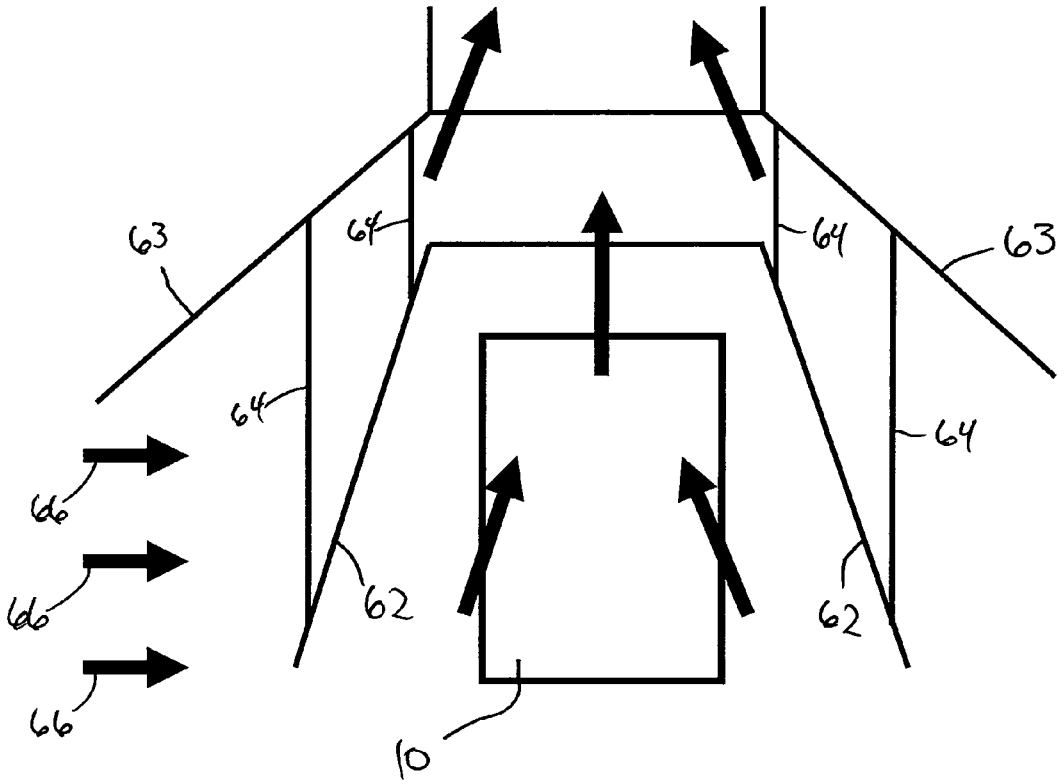
FIG. 18 shows schematically a subsea cooler with an ejector augmenting the current of sea water flowing through the subsea cooler.
Figure 19:
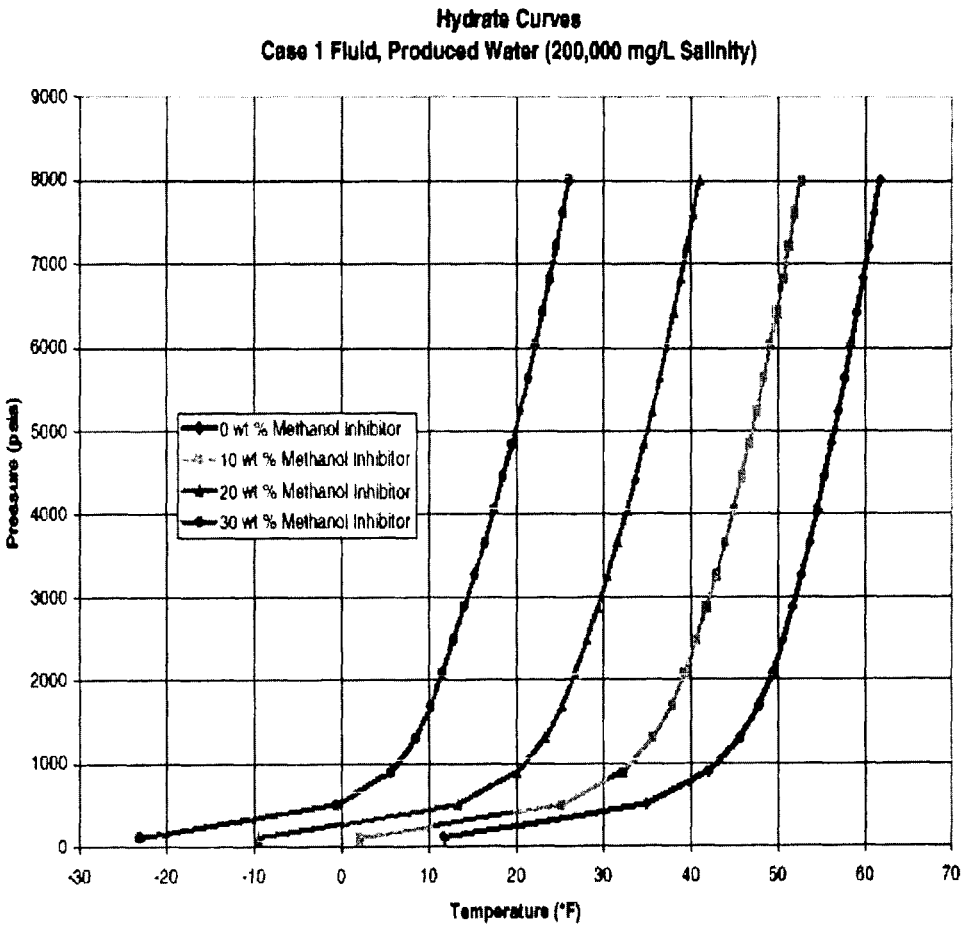
FIG. 19 shows exemplary hydrate cures for uninhibited brine and for brine with various amounts of hydrate inhibitor.

In FIG. 18 there is shown an alternative way of increasing cooling capacity of the subsea cooler. Above the subsea cooler 10 there is provided an inner skirt 62, preferably having a conical shape. Outside the inner skirt 62 there is further provided an outer skirt 63, also preferably with a conical shape. The inner and outer skirts may be connected by the necessary number of plates 64. Between the inner and outer skirts 62, 63 there is thereby created a flow path. The outer skirt 63 and the inner skirt 62 is adapted such that the sea current 66 flows into the flow path and are thereafter directed upwards as indicated in the figure. The flow of current up through the flow path between the inner and outer skirts will also create a flow of sea water through the subsea cooler 10 as indicated on the figure, thereby increasing the cooling capacity of the subsea cooler 10.

The invention claimed is:

1. A subsea cooler for the cooling of a fluid flowing in a subsea flow line, the subsea cooler comprising:

an inlet and an outlet which are connectable to the subsea flow line, and a plurality of cooling sections arranged in fluid communication with the inlet and the outlet of the subsea cooler, wherein each cooling section comprises:

a plurality of cooling pipes configured to exchange heat energy with surrounding sea water, a valve configured to regulate the flow of fluid through the cooling section, thereby reducing a cooling area of the subsea cooler and decreasing a cooling of the fluid to melt accumulated wax or hydrate or jet sand or debris out of the cooling section;

at least one distributing pipe for each cooling section that extends between a primary distribution point and respective cooling sections, wherein the distributing pipes are inclined relative to a horizontal plane when the subsea cooler is installed on a seabed such that the fluid flows downwards from the primary distribution point toward the cooling sections.

2. The subsea cooler according to claim 1, wherein the cooling sections are symmetrically arranged around a longitudinal center axis of the subsea cooler.

3. The subsea cooler according to claim 1, wherein the cooling pipes are symmetrically arranged around a longitudinal center axis of the respective cooling sections.

4. The subsea cooler according to claim 1, wherein the subsea cooler comprises first distributing pipes extending from the primary distributing point to respective secondary distribution points and at least two distributing pipes extending from each secondary distribution point to respective cooling sections, the distributing pipes being inclined relative to a horizontal plane when the subsea cooler is installed on the seabed.

5. The subsea cooler according to claim 1, wherein subsea cooler is provided with one or more valve means such that the flow of fluid through the cooling sections may be regulated individually.

6. The subsea cooler according to claim 1, wherein each cooling section comprises an inlet manifold and an outlet manifold, and that the plurality of cooling pipes extend between the inlet manifold and the outlet manifold of each cooling section.

7. The subsea cooler according to claim 6, wherein the inlet manifolds are arranged above the corresponding outlet manifolds such that the fluid flows downwardly through the cooling pipes.

8. The subsea cooler according claim 6, wherein the subsea cooler is configured such that the cooling pipes extend in a substantially vertical direction between the inlet manifolds and the corresponding outlet manifolds when the subsea cooler is installed.

9. The subsea cooler according to claim 1, wherein the cooling sections are provided with a diffuser which distributes the fluid flow evenly between the cooling pipes of the cooling sections.

10. The subsea cooler according to claim 9, wherein the diffuser is provided with flow blocking means which partially covers the diffuser's cross sectional area of fluid flow.

11. The subsea cooler according to claim 10, wherein the flow blocking means comprises a plate shaped body which is provided centrally in the diffuser's cross sectional area of fluid flow.

12. The subsea cooler according to claim 6, wherein the inlet manifolds are provided with at least one guide vane which guides fluid from the inlet of the inlet manifold to the cooler pipes.

13. The subsea cooler according to claim 6, wherein there is provided a blind-T upstream each inlet manifold.

14. The subsea cooler according to claim 1, wherein the distributing piping of the subsea cooler is provided with one or more flow restrictions such that liquid droplets are broken down into smaller droplets and a homogeneous multiphase flow is obtained.

15. The subsea cooler according to claim 1, wherein the subsea cooler comprises a bypass line such that at least a portion of the fluid flowing through the subsea cooler may bypass the at least two cooling sections.

16. The subsea cooler according to claim 1, wherein the subsea cooler comprises a vessel, pipe or container which is arranged in fluid communication with the cooling sections and is provided with a volume which is large enough to accommodate any liquid fraction of the fluid contained in the cooling sections such that the subsea cooler can be quickly drained.

17. The subsea cooler according to claim 16, wherein the vessel, pipe or container is thermally insulated.

18. The subsea cooler according to claim 16, wherein the vessel, pipe or container is arranged such that the cooling sections of the subsea cooler is self-draining due to gravitational forces acting on the fluid in the cooling sections.

19. The subsea cooler according to claim 16, wherein there is provided means for injecting inhibitors into said vessel, pipe or container.

20. The subsea cooler according to claim 1, wherein the subsea cooler comprises at least one cold zone which is configured such that the temperature of the fluid flowing through the cold zone is lower than the fluid flowing through the rest of the subsea cooler.

21. The subsea cooler according to claim 20, wherein cold zone comprises at least one cooling pipe which is provided with a temperature lowering means such that fluid flowing through said at least one cooling pipe has a lower temperature than the fluid flowing through the cooling pipes which are not provided with temperature lowering means.

22. The subsea cooler according to claim 21, wherein the temperature lowering means comprises a constriction provided in said at least one cooling pipe, or one or more cooling fins provided on said at least one cooling pipe, or a cooling pipe with a smaller diameter than the rest of the cooling pipes of the subsea cooler.

23. The subsea cooler according to claim 1, wherein the subsea cooler comprises at least one warm zone which is configured such that the temperature of the fluid flowing through the warm zone is higher than the fluid flowing through the rest of the subsea cooler.

24. The subsea cooler according to claim 23, wherein the warm zone comprises at least one cooling pipe which is provided with a temperature raising means such that fluid flowing through said at least one cooling pipe has a higher temperature than the fluid flowing through the cooling pipes which are not provided with the temperature raising means.

25. The subsea cooler according to claim 24, wherein the temperature raising means comprises insulating means provided on said at least one cooling pipe, or providing the subsea cooler with a cooling pipe with a larger diameter than the rest of the cooling pipes of the subsea cooler.

26. The subsea cooler according to claim 20, wherein the cold zone and/or the warm zone is/are provided with at least one sensor measuring the relative change in one or more physical properties of the fluid flow whereby an early warning of fouling can be obtained.

27. The subsea cooler according to claim 26, wherein the at least one sensor measures the relative change in differential pressure between the cold and the warm zones.

28. The subsea cooler according to claim 26, wherein the at least one sensor measures the temperature of the fluid flowing through the cold and the warm zones.

29. The subsea cooler according to claim 26, wherein the at least one sensor comprises one or more ultrasonic speed sensors which measures the speed of the fluid flowing through the cold and the warm zones.

30. The subsea cooler according claim 1, wherein the subsea cooler comprises a riser pipe extending between the inlet of the subsea cooler and at least up to the primary distributing point, the riser pipe being adapted for relative movement between the riser pipe and the primary distributing point.

31. The subsea cooler according to claim 1, wherein the subsea cooler comprises a sea current driven impeller comprising a propeller arranged such that the propeller draws water past the cooling sections of the subsea cooler.

32. The subsea cooler according to claim 1, wherein the subsea cooler comprises at least one skirt which at least partly surrounds the subsea cooler such that the flow of sea water past the cooling sections is further increased.

33. The subsea cooler according to claim 1, wherein the subsea cooler comprises a control system which communicates with and controls the subsea cooler's valve devices such that the fluid flow through the cooling sections may be regulated independently of each other.

34. The subsea cooler according to claim 1, wherein the fluid is a multiphase fluid comprising hydrocarbons and/or water.

* * * * *